United States Patent [19]

Dehaan

[11] 4,337,926

[45] Jul. 6, 1982

[54] WINCH CONTROL

[75] Inventor: Peter H. Dehaan, Ayr, Canada

[73] Assignee: Eaton Corporation, Cleveland, Ohio

[21] Appl. No.: 182,877

[22] Filed: Sep. 2, 1980

[51] Int. Cl.[3] ..... B66D 1/14

[52] U.S. Cl. ..... 254/365; 188/105; 188/170; 192/17 A; 254/367; 254/379

[58] Field of Search ..... 254/379, 349, 367, 365; 188/170, 105; 192/17 A, 17 C

[56] References Cited

U.S. PATENT DOCUMENTS

| | | | |
|---|---|---|---|
| 3,300,190 | 1/1967 | Blase | 254/379 |
| 3,550,735 | 12/1970 | Olsen | 192/17 C |
| 3,907,075 | 9/1975 | Christison et al. . | |
| 4,042,215 | 8/1977 | Hakes | 254/361 |
| 4,076,219 | 2/1978 | Behrends et al. | 254/349 |
| 4,093,034 | 6/1978 | Curley et al. | 254/379 X |
| 4,093,184 | 6/1978 | Wieschel | 254/379 |

*Primary Examiner*—Billy S. Taylor

*Attorney, Agent, or Firm*—C. H. Grace; F. M. Sajovec

[57] ABSTRACT

A log skidder winch control system (10) includes a manually actuated master cylinder (22) connected to the winch drum brake release cylinder (18) to allow the winch cable (44) to be winched out gradually independent of the vehicle hydraulic system. The master cylinder is connected in the hydraulic line between the winch control valve (34) and the drum brake release cylinder, and normally serves only as a conduit for oil flow to the brake release cylinder when the control valve is put in a "free spool" condition. With the control valve is neutral the master cylinder can be manually actuated to pressurize the brake release cylinder to provide gradual release of the winch drum brake (26).

4 Claims, 2 Drawing Figures

WINCH CONTROL

The present invention relates generally to winches, and more particularly to a hydraulic control system for a winch of the type used on log skidders.

Log skidders generally employ the type of winch which is driven by a power take off from the skidder power plant, and which incorporates a hydraulically actuated, normally engaged brake and a hydraulically actuated, normally disengaged clutch to control the reeling in and out of a cable used to haul logs.

When a load of logs is to be winched in for hauling, the clutch is engaged to connect the cable drum of the winch to the power take-off. When the cable is to be winched out, the clutch is left released, and the normally engaged brake gradually released to allow the weight of the load to pull the cable off the drum. The prior art system for winching in and out, using the vehicle hydraulic system for brake and clutch actuation is quite effective where the winch is to be put into a so-called "free spool" mode, wherein the brake is released completely and the load is allowed to drop rapidly. However, where it is desirable to drop the load slowly, and/or when more precise lowering of the load is desired, it can be difficult to control the brake using the vehicle hydraulic system.

What the present invention provides is an auxiliary brake control incorporating a manually actuated master cylinder which can be selectively engaged for precise control of the brake to lower a load slowly and accurately. In accordance with the invention a manually actuable master cylinder is put in series with the brake release circuit of the winch control valve so that when the brake release cylinder is not pressurized by the hydraulic system through the winch control valve, the master cylinder can be actuated manually to pressurize the brake release cylinder. Use of a manually actuated master cylinder permits more precise contol of the brake than can be obtained using the system control valve.

Figure 1:
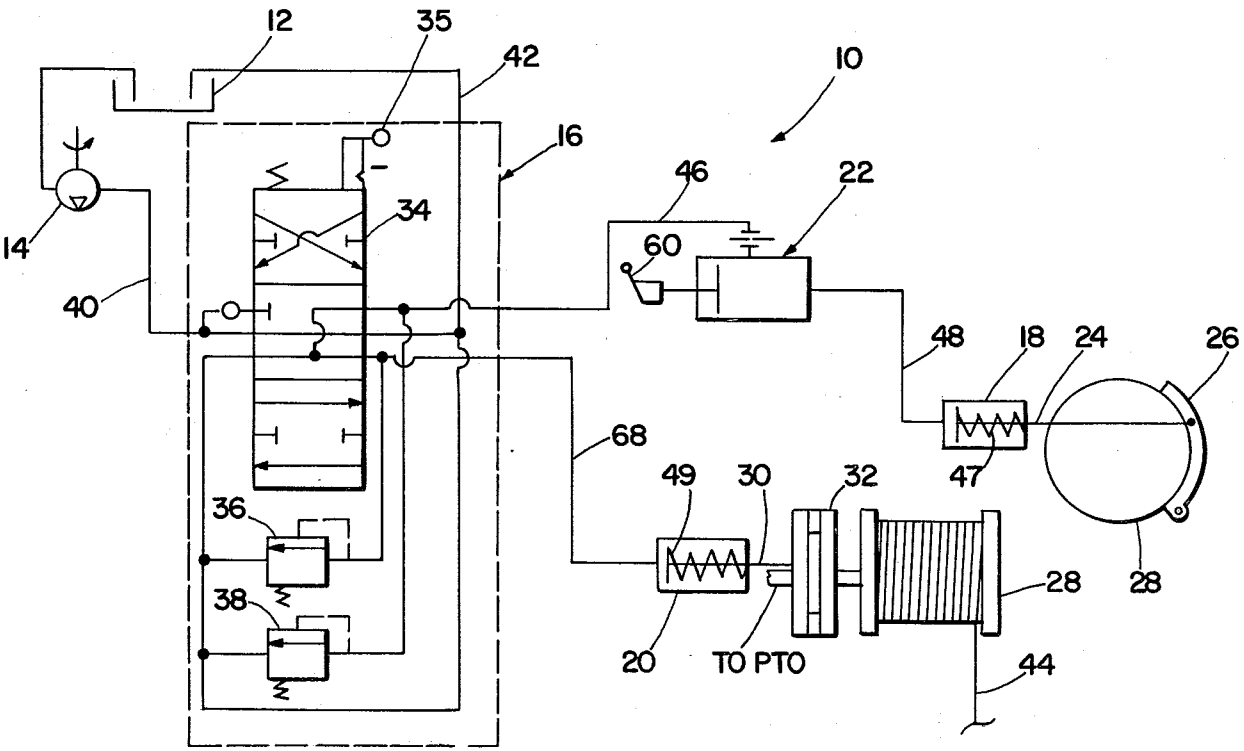
Figure 2:
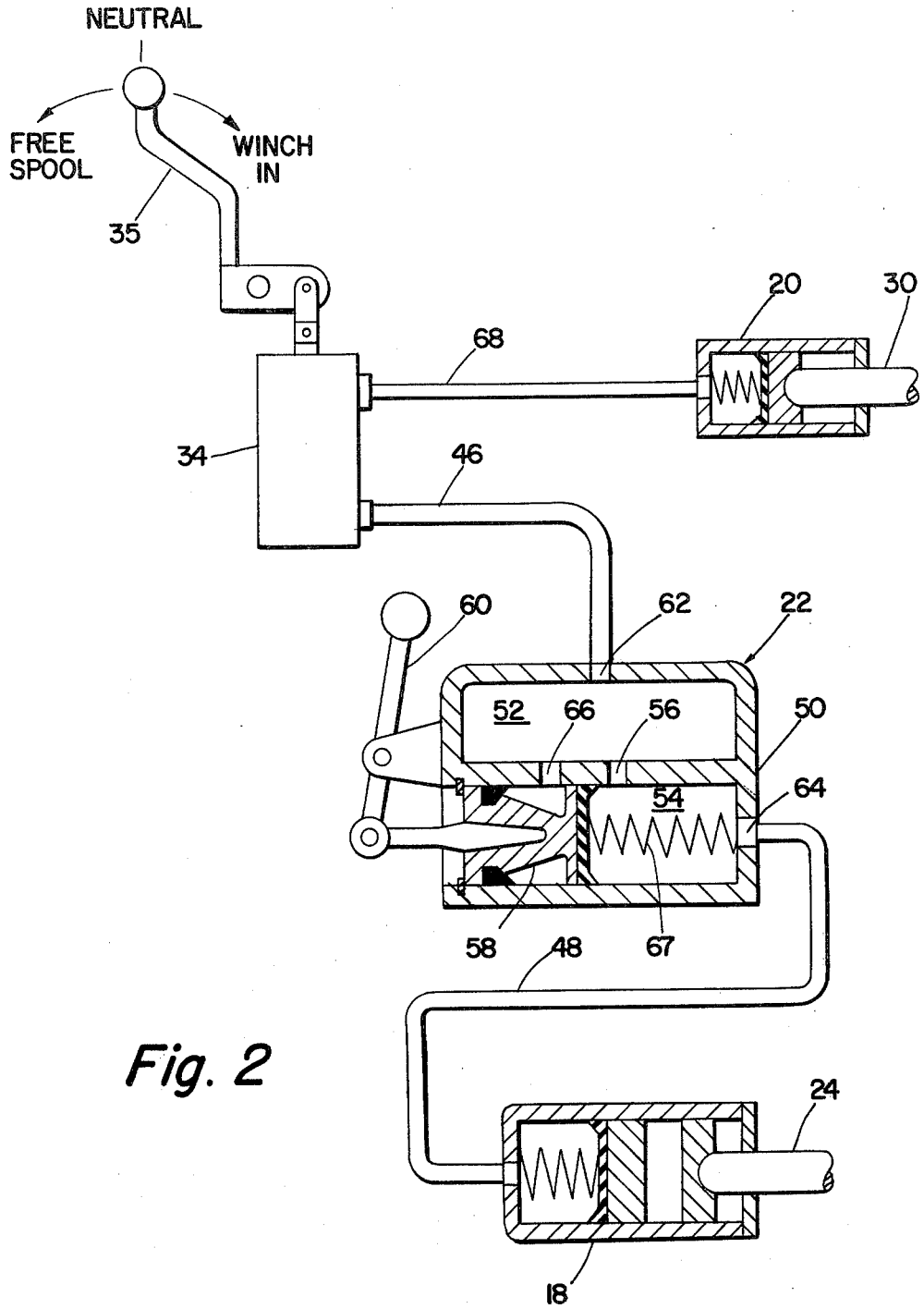

Other features and advantages of the present invention will become apparent from the following description when taken in connection with the accompanying drawings, wherein:

FIG. 1 is a schematic diagram of a hydraulic winch control system incorporating the invention; and FIG. 2 is a somewhat schematic sectional view of the master cylinder of the present invention, and its associated components.

Referring to FIG. 1, there is schematically illustrated a hydraulic system 10 for a log skidder winch comprising a supply tank 12, a pump 14, a control valve assembly 16, a brake release cylinder 18, a clutch actuating cylinder 20, and a brake master cylinder 22. The output member 24 of the brake release cylinder 18 is connected to a normally engaged brake 26 which normally maintains the winch drum 28 stationary. The output member 30 of the clutch cylinder 20 is connected to a normally disengaged clutch 32 which controls the engagement of the drum 28 with the power take-off (PTO) of the skidder. The control valve assembly 16 comprises a spool valve element 34, and first and second relief valves 36 and 38 respectively.

In normal operation of the skidder, with the winch not in use, the spool valve 34 will be in the position shown in FIG. 1, wherein hydraulic fluid flows from the pump 14 through the valve 34 via line 40, and then back to tank 12 via line 42.

When it is desired to winch out the cable 44 rapidly from the drum 28, the control handle 35 of valve is rotated counterclockwise as shown in FIG. 2 to shift the valve 34 upward as shown in FIG. 1, to a "free spool" position wherein the drum 28 is allowed to run free, except for sufficient internal drag to prevent overrunning of the cable, to allow the cable to be played out as required. In this position of the valve oil flows from the pump through the valve 34 via line 40, through line 46 to the master cylinder 22, and through the master cylinder to the brake release cylinder 18 via line 48. When cylinder 18 is pressurized sufficiently to overcome the force of actuating spring 47, output member 24 moves to the right as shown to disengage the brake 26 from the cable drum.

Referring to FIG. 2, the master cylinder comprises a housing 50, a reservoir 52 formed within the housing, a cylinder 54 formed in the housing and connected to the reservoir by a port 56, a piston 58 within the cylinder, a control handle 60 pivotally attached to the piston 58, an inlet port 62 connecting line 46 to the reservoir 52, and an outlet port 64 connecting the cylinder 54 with line 48. A vent port 66 connects the reservoir 52 with the area of the cylinder 54 behind the piston. A spring 67 biases the piston 58 to the position shown. The master cylinder is of a well-known type similar to those used in automotive braking systems, and will not be described in further detail herein. Under normal free spooling, the control handle 60 is left in the position shown in FIG. 2, and oil flows through the master cylinder via inlet port 62, reservoir 52, port 56, cylinder 54 and outlet port 64.

When it is desired to retract the cable 44, the control handle 35 is rotated clockwise (FIG. 2) to shift valve 34 downward as shown in FIG. 1 to a "winch in" position wherein the clutch 32 is engaged to connect the winch drum to the vehicle PTO, while the brake 26 is disengaged. In this position of the valve, oil flows from the pump through the valve 34 via line 40, and through line 68 to the clutch cylinder 20. When cylinder 20 is pressurized sufficiently to overcome the force of return spring 49, output member 30 moves to the right as shown to engage the clutch 32 to drive the winch drum. When the cutch is engaged, oil in brake cylinder 18 is allowed to flow back to tank via line 42. In the illustrative embodiment the brake 26 is of a type which is self energizing in the "free spool" direction, so that when the valve 34 is in the "winch in" position wherein the winch drum rotates in the opposite direction, the brake 26 will effectively disengage even though there is no pressure on the brake release cylinder.

Referring particularly to FIG. 2, in accordance with the invention means are provided to release the brake 26 manually to allow the winch drum to be released slowly when it is desired to drop a load slowly and more precisely than can be accomplished under power operation of the winch control system as described above. When manual brake release is desired, the valve 34 is left in the neutral position shown in FIG. 1, and the brake is released by means of the master cylinder 22.

When the valve 34 is in the neutral position, the brake cylinder 18 is open to tank via lines 48, 46 and 42; the master cylinder reservoir 52 and cylinder 54 are filled with oil; and the brake 26 is in its normally engaged condition. To allow the winch drum to free spool under manual control the control handle 60 is moved to the left, or counterclockwise, as shown in FIG. 2, to move the piston 58 to the right. Once the piston 58 passes the port 56, the master cylinder and brake release cylinder become isolated from the remainder of the control system, and the brake cylinder 18 is pressurized to gradually release the brake 26 in proportion to the movement of the piston 58.

When full free spooling or winching in of the cable 44 is desired, the handle 60 is returned to its FIG. 2 position to open port 56 and return the system to a condition in which winching in and free spooling are controlled by the position of the control valve 34.

I claim:

1. In a winch comprising a drum; a brake normally engaged with said drum; power input means for rotating said drum in a first direction; clutch means operable to selectively engage said power input means with said drum; and means for controlling said winch comprising a pump, a first actuating clyinder connected to the outlet of said pump and operable to engage said clutch means, a second actuating cylinder connected to the outlet of said pump and operable to selectively disengage said brake, and valve means connected between said pump and said first and second actuating cylinders having a first position connecting the outlet of said pump to said first actuating cylinder and a second position connecting the outlet of said pump to said second actuating cylinder; the improvement including a manually actuated master cylinder assembly connected in series between said valve means and said second actuating cylinder and operable to selectively pressurize said second actuating cylinder independent of said pump.

2. Apparatus as claimed in claim 1, in which said manually actuated master cylinder assembly comprises a housing, a reservoir formed in said housing, a master cylinder formed in said housing, a port connecting said reservoir with said master cylinder, a piston received within said master cylinder and movable therein, inlet port means formed through said housing and opening into said reservoir, and outlet port means formed through said housing and opening into said master cylinder.

3. Apparatus as claimed in claim 2, including manually operable means mounted on said housing and operable to move said piston in said master cylinder.

4. Apparatus as claimed in claim 3, in which said piston is movable between a first position wherein said port connecting said reservoir and said master cylinder is open to permit flow from said inlet port means to said outlet port means and a second position wherein said port is closed to prevent flow between said inlet port means and said outlet port means, said master cylinder assembly including means biasing said piston toward said first position.

* * * * *